United States Patent [19]

Csaszar et al.

[11] 4,401,089

[45] Aug. 30, 1983

[54] ULTRASONIC TRANSDUCER

[75] Inventors: Gabor Csaszar, Cary; Fred M. Goldman, Glenview; Gernot Oehley, Chicago; Edward J. Svoboda, Hinsdale, all of Ill.

[73] Assignee: Midas International Corporation, Chicago, Ill. ; a part interest

[21] Appl. No.: 232,693

[22] Filed: Feb. 9, 1981

[51] Int. Cl.[3] ..... F02M 29/00

[52] U.S. Cl. ..... 123/536; 123/537; 123/590

[58] Field of Search ..... 123/536, 590, 537, 538; 48/180 R; 261/DIG. 48; 239/102, 104; 310/321, 323, 325

[56] References Cited

U.S. PATENT DOCUMENTS

| | | | |
|---|---|---|---|
| 2,453,595 | 11/1948 | Rosenthal | 123/590 |
| 2,836,738 | 5/1958 | Crownover | 310/328 |
| 3,076,903 | 2/1963 | Schwartz | 310/328 |
| 3,093,760 | 6/1963 | Tarasevich | 310/321 |
| 3,977,383 | 8/1976 | Nagumo | 123/590 |
| 4,038,348 | 7/1977 | Kompanek | 261/DIG. 48 |
| 4,123,481 | 10/1978 | Herold | 261/DIG. 48 |
| 4,167,158 | 9/1979 | Martin | 123/590 |

FOREIGN PATENT DOCUMENTS

| | | | |
|---|---|---|---|
| 55-35185 | 3/1980 | Japan | 123/590 |

*Primary Examiner*—Ronald H. Lazarus

*Attorney, Agent, or Firm*—Allegretti, Newitt, Witcoff & McAndrews

[57] ABSTRACT

An ultrasonic transducer is provided substantially at the hot spot in an engine manifold for vaporizing the fuel from the carburetor prior to entry of the fuel-air mixture into the cylinders. The transducer comprises a crystal adapted to be vibrated at a high frequency on the order of at least 1,000,000 Hz and a resonator tuned to the frequency of the crystal and operatively secured to the crystal, said transducer having an active surface adapted to be contacted by the fuel for finely vaporizing same. The fine vaporization or gasification of the fuel (gasoline, for example) prior to entry into the cylinders causes a more complete burning of the fuel. As a result, the engine delivers more power with less fuel, while carbon monoxide and hydrocarbon emissions are reduced.

In operation, the ultrasonic transducer enhances cold weather startup and operation, eliminates engine flooding, smooths out engine idle, and improves pick up and acceleration by increasing power at low engine RPM. Engine power is boosted, while saving gasoline. The ultrasonic transducer can be installed into the intake manifold below the carburetor without modifying the structure of the carburetor or the intake manifold.

15 Claims, 9 Drawing Figures

ULTRASONIC TRANSDUCER

BACKGROUND OF THE INVENTION

This invention pertains to an ultrasonic transducer for use at the hot spot in the manifold of an internal combustion engine to finely vaporize the fuel and enhance engine performance, particularly, starting in cold weather, and acceleration of the internal combustion engine. By providing fast cold weather starting, eliminating cold weather warm up, and permitting operation of the engine with leaner fuel-air mixtures, gasoline mileage can be improved.

The prior art discloses many different attempts at improving carburetion to enhance engine operation. Heavey U.S. Pat. No. 1,939,302 shows a carburetion apparatus utilizing a crystal below a pool of gasoline to help vaporize same into an air stream and a crystal with needles secured thereto downstream from the first crystal to help comminute larger droplets in the fuel-air mixture.

Vang U.S. Pat. No. 2,414,494 suggests placing a vibration disc inside the cylinder of a diesel engine for the purpose of atomizing the fuel delivered into the cylinder. In another embodiment, Vang suggests placing a vibration disc in the manifold of a gasoline engine near the intake port of each of the cylinders.

Vang U.S. Pat. No. 2,454,900 shows an oscillating device supported by a spider for applying vibrations to the fuel-air mixture.

Magui et al U.S. Pat. No. 2,704,535 reveals a device for improving carburetion in an internal combustion engine which comprises an annular supersonic wave emitter disposed on a duct communicating to the manifold of an internal combustion engine for better gasifying the fuel fed to the manifold.

Paul U.S. Pat. No. 2,769,698 pertains to a basket-type fuel mixer insert adapted to impart turbulence to the fuel mixture as it enters as internal combustion engine.

The Grieb U.S. Pat. No. 2,791,990 pertains to an ultrasonic mixing apparatus for an internal combustion engine in which laminar flow conditions pervail so that the gaseous fuel charge will flow smoothly therethrough and into the cylinders with a minimum of pressure drop within the system. Grieb provides a hollow rectangular transducer element which is porous so that fuel can be fed into the air stream through the transducer element itself.

Grieb U.S. Pat. No. 2,791,994 reveals an ultrasonic mixing apparatus having a pair of annular transducers in series in a duct.

Brody U.S. Pat. No. 3,735,744 suggests placing a fuel mixture device in the manifold of an internal combustion engine. The fuel mixture device comprises a plurality of closely packed sinuous members which define a plurality of generally axially extending twisted passages which are laterally intercommunicating.

Scarpa U.S. Pat. No. 3,433,461 discloses a piezoelectric generating element comprising a crystal bonded to a mounting element, each having a thickness which is substantially a half-wavelength in the resonant thickness frequency.

Thatcher U.S. Pat. No. 3,533,606 shows an ultrasonic carburetor system which employs a relatively large fuel input jet means for fuel feeding.

Larson U.S. Pat. No. 3,544,290 reveals a fuel atomizing unit which comprises a strainer screen upstream of a vibratory structure in the form of a vane resonator or propellor resonator located in the path of the fuel-air mixture to help atomize fuel passing through the duct in which the strainer screen and resonator are disposed.

Priegel U.S. Pat. No. 3,955,545 shows an ultrasonic fuel atomizer apparatus adapted to be inserted between a standard carburetor and the intake manifold of an internal combustion engine. The atomizer apparatus comprises a disc affixed to an exciter which drives the disc at the resonant frequency of the entire system. The disc and exciter are housed within a chamber, with the disc being disposed laterally with respect to the air flow from the carburetor.

Nagumo U.S. Pat. No. 3,977,383 pertains to a diaphragm opposed to an inlet of the riser of an intake manifold and means for applying a high frequency alternate electric voltage across both sides of the diaphragm to induce mechanical vibration of the diaphragm.

Kompamek U.S. Pat. No. 4,038,348 suggests the use of a cylindrical transducer below a carburetor in an internal combustion engine.

Asai U.S. Pat. No. 4,105,004 shows a cylindrical transducer that is adapted to cooperate with anozzle for atomizing fuel discharged from the nozzle onto a peripheral wall of the transducer. A control device controls the amount of fuel being injected through the injection nozzle in response to the running conditions of the internal combustion engine.

Asai U.S. Pat. No. 4,106,459 discloses a carburetor which includes a cylindrical transducer and a nozzle cooperating therewith.

Martin U.S. Pat. No. 4,176,634 reveals a fuel injection system comprising a vibrating fuel injector and a vibrating butterfly or sliding valve so positioned that it receives fuel from the injector and further vibrates the fuel to break it up even more.

Volkswagen has experimented with a "hedgehog-like" heater insert mounted in the intake manifold of an internal combustion engine. This insert is electrically heated by PTC elements at low temperatures. There is no suggestion of the use of an ultrasonic transducer to achieve the advantages of the present invention.

Some of these prior art devices require modification of the carburetor or the engine to utilize the vaporizing device. Some prior art devices are relatively complex and costly and are incapable of performing as does the present invention. None of these prior art devices suggest the present invention.

The present invention stems from attempts to develop the carburetion system for internal combustion engines as disclosed in Csaszar and Oehley U.S. Pat. No. 4,029,064. The principle of vaporization is employed in a much simpler and less costly device that does not require any alteration of the carburetor or the intake manifold of an internal combustion engine for installation of the device into the intake manifold.

The present invention provides an improved ultrasonic transducer wherein the disadvantages and deficiences of prior constructions are obviated.

There has been provided by this invention an improved ultrasonic transducer adapted to be disposed at the hot spot in the manifold of an internal combustion engine for enhancing cold weather starting of the internal combustion engine and improving the performance of the internal combustion engine.

This invention provides an ultrasonic transducer adapted to be inserted into the hot spot in the intake manifold of an engine, without altering the engine structure or the engine specifications.

Further, this invention provides an improved ultrasonic transducer adapted to be positioned in the intake manifold of an internal combustion engine for assuring cold weather starting of the engine and eliminating engine stall when accelerating the cold engine under load.

Another object of this invention is to provide an improved ultrasonic transducer adapted to be inserted below the carburetor in the manifold of an automotive engine for improving engine start up and performance, such transducer including a crystal operable at a range in excess of 1,000,000 Hz and a resonator operatively connected to said crystal for vibration by same, said resonator being tuned to the frequency of said crystal.

Still another object of the present invention is to provide an improved ultrasonic transducer adapted to be inserted between the carburetor and cylinders of an automotive engine for finely vaporizing the fuel supplied to the cylinders to boost engine power while saving fuel.

A further object of this invention is to provide an improved ultrasonic transducer that will gasify fuel fed to the cylinders in an automotive engine into a very fine vapor to cause more complete burning of the fuel so as to deliver more power with less fuel, while reducing carbon monoxide and hydrocarbon emissions from the engine.

Yet another object of this invention is to provide an improved ultrasonic transducer of simple construction that is relatively inexpensive, can be easily installed into an intake manifold of an engine without any modification of the intake manifold, and will operate to finely vaporize the fuel fed to the cylinders of the engine so as to improve engine performance.

Other objects and advantages will be made more apparent hereinafter.

BRIEF DESCRIPTION OF THE DRAWING

There is shown in the attached drawing presently preferred embodiments of the present invention, wherein like numerals refer to like elements in the various views.

DETAILED DESCRIPTION OF THE PRESENT INVENTION

Figure 1:
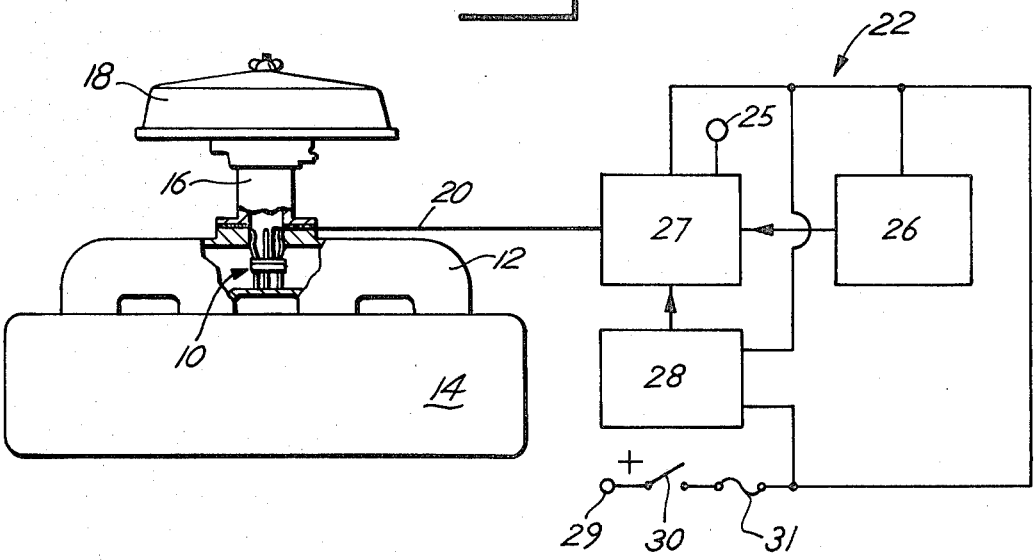
FIG. 1 illustrates schematically an internal combustion engine embodying the ultrasonic transducer of the present invention disposed between the carburetor and intake manifold and also includes an electrical block diagram for the ultrasonic transducer.

There is shown in FIG. 1 a presently preferred embodiment of the present invention wherein an ultrasonic transducer 10 is disposed within the intake manifold 12 of an internal combustion engine 14. The engine 14 comprises the usual carburetor 16 and air filter 18 disposed above the carburetor 16. Ultrasonic transducer 10 is mounted inside the intake manifold 12 underneath the carburetor barrel and just above the hot spot of the intake manifold. No modifications of the manifold are required. No modification of the curburetor is required. It will be understood that the following description of FIG. 1 assumes a single barrel carburetor. Obviously, additional transducers can be used as needed for 2-barrel and 4-barrel applications and the capacity of the electrical circuit would be increased as needed.

The ultrasonic transducer 10 is adapted to be connected via lead wire 20 to an electrical circuit 22. The electrical circuit 22 is comprised of an oscillator 26, a power amplifier 27, and a modulator 28 connected to the battery 29 via the ignition switch 30. Also, in the circuit is a fuse 31. The electrical components, oscillator, power amplifier, and modulator are each basically of known design and contained in a single housing which is grounded by its connection to the metal frame of the automobile.

Essentially, the electrical circuit provides high frequency power to the ultrasonic transducer which is converted to accoustical power. The electrical power, and as a consequence, the accoustical power is not continuously applied to the ultrasonic transducer 10, but rather is applied in short bursts of approximately fifty percent (50%) duty cycle. The approach besides saving fifty percent (50%) of the primary electrical energy taken from the battery by the electronic circuit, also effects more efficient vaporization of the gasoline reaching the surface of the ultrasonic transducer 10.

More specifically, when the ignition switch 30 is closed, the automotive battery 29 provides power to the oscillator 26, which supplies low level energy to the power amplifier 27. The basic frequency from oscillator 26 is amplified by power amplifier 27 to the system requirements, at least 1,000,000 Hz and preferably 1,300,000 Hz. In use on an automobile ignition switch 30 is turned on (closed) and the accelerator pedal is depressed once or twice. The gasoline reaching the transducer 10 is vaporized. Then the ignition switch 30 is moved to start the engine in normal fashion. The engine will start promptly, even if cold.

With steady state operation of the electrical circuit 22, it was found the gasification or vaporization of the fuel was not complete. Gasoline on the active surface of the transducer 10 took the form of a cone of liquid sitting atop a thin layer of vapor. Only the bottom part of the cone of fluid was vaporized, and not the entire cone or droplet. Unexpectedly, it was found that this problem was obivated by applying power to the transducer 10 in bursts of approximately fifty percent (50%) duty cycle. Use of the modulator 28 in conjunction with the power amplifier to provide a discontinuous supply to the transducer 10 caused the vapor layer below the gasoline cone to collapse during the off cycle, and when the next on cycle commenced, the base of the cone was in full contact with the active surface of the resonator and was converted to a fine mist. The result is that gasoline droplets in the fuel-air mixture from the carburetor are completely vaporized by use of the present invention. A uniform fine mist of gasoline is carried in the air to each of the cylinders of the engine 14. The complete vaporization of gasoline is accomplished with a substantially less draw upon the battery of automobile or like vehicle in which the present invention is used.

Basically, the upper surface of the ultrasonic transducer provides an active surface on which raw gasoline is collected. The ultrasonic transducer of this invention is vibrated at a frequency of excess of 1,000,000 Hz, preferably, 1,300,000 Hz. Very high pressures are applied to the gasoline, which is almost instantly vaporized into droplets of less than ten microns in diameter. This fine gasoline mist mixed together with the incoming air is fed to the cylinders of the engine 14. This vaporizing process is independent of the temperature of the gasoline and the air, so that the engine is greatly aided in cold starting and in acceleration of the engine. Since the gasoline is always vaporized with this device, whether the engine is hot or cold, fuel economy is assisted, without adversely effecting engine performance. Further, the fine mist of gasoline if fed more uniformly to each of the cylinders, which is a factor in improved fuel usage.

Figure 2:
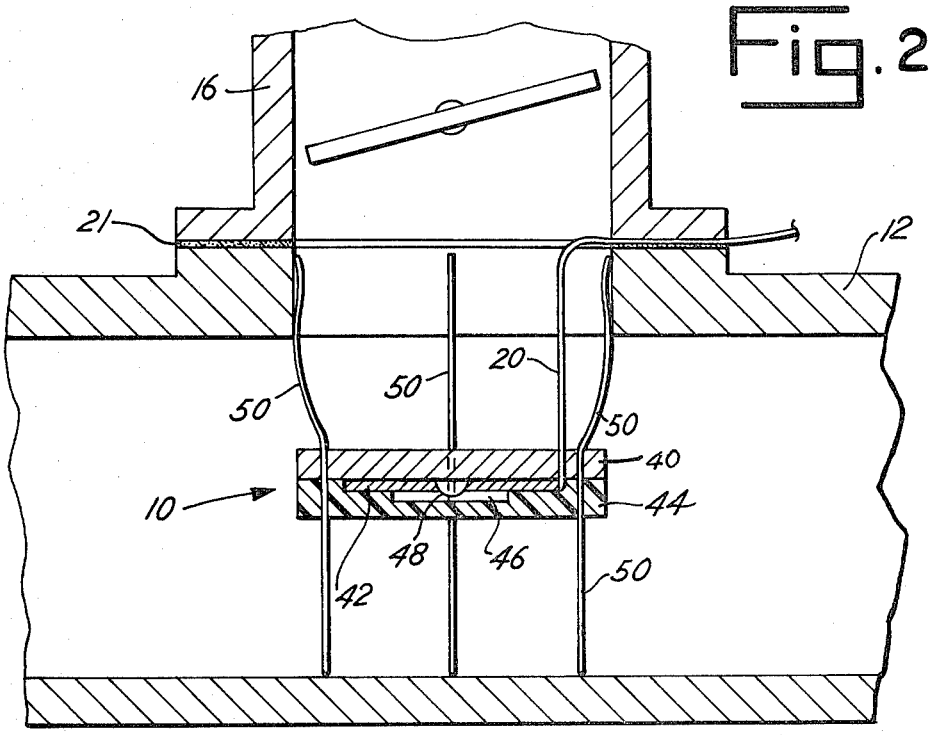
FIG. 2 is an enlarged sectional view of the ultrasonic transducer at the hot spot in the intake manifold of an internal combustion engine.
Figure 3:
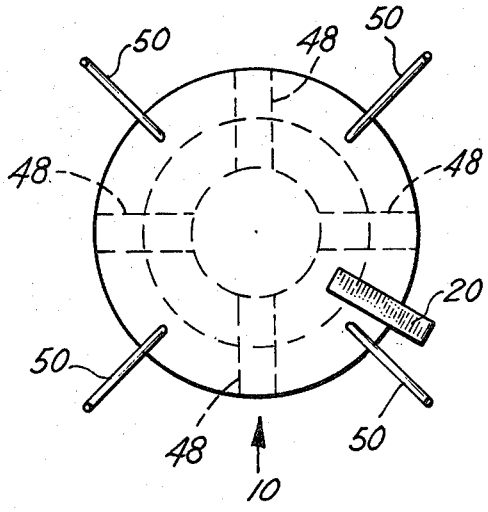
FIG. 3 is a plan view of the ultrasonic transducer of FIG. 2.

Turning to FIGS. 2 and 3, there is better shown the ultrasonic transducer 10. The transducer 10 comprises a resonator 40 to which is operatively connected the crystal 42 and a heat resisting insulator 44. The resonator 40, crystal 42 and insulator 44 may be suitably bonded or fastened together, for example, by an epoxy to form an assembly.

The resonator 40 is preferably made from metal, for example, aluminum. The crystal 42 is preferably made from barium titranate, though other materials could be employed as is known in the art. Preferably, the crystal 42 will vibrate at a frequency in excess of 1,000,000 Hz and a frequency of 1,300,000 Hz has been found to be very satisfactory in preliminary tests.

The resonator 40 cooperates in a synergistic manner with the crystal 42 so as to produce far greater amounts or volumes of mist than was possible using the crystal alone. The practical crystal is not a uniformly vibrating body. The resonator of metal provides a more uniformly vibrating body. By operatively associating the crystal with a resonator as in the present invention, the improved results are obtained. The crystal is manufactured to a thickness to produce the desired frequency. The resonator must be properly tuned to the frequency of the crystal. Best results have been obtained where the resonator has a thickness of $\frac{1}{4}$ wavelength or an odd multiple of $\frac{1}{4}$ wavelength. A transducer or this invention is capable of producing 20 horsepower energy. In other words, a transducer about one inch in diameter is capable of vaporizing at an average rate of $\frac{1}{2}$ pound of fuel per horsepower per hour. This is consistent with an engine calibrated to 0.5 brake specific fuel consumption.

A chamber 46 is defined between the bottom of the crystal 42 and the insulator 44. The chamber 46 is vented via vent holes 48 so as to enhance vibration of the crystal 42, by avoiding the buildup of gasoline below the crystal that would otherwise result. An alternative of sealing the chamber below the crystal is much more costly than the present arrangement. As best shown in FIG. 3, there are four vent holes 48 formed in the insulator 44.

The transducer 10 also includes four spring wires 50 which are intended to engage the wall of the intake manifold 12 so as to retain the transducer 10 in place substantially at the hot spot of the intake manifold. The spring wires 50, preferably made from steel, extend through the transducer 10 and the bottom portions may engage the bottom of the intake manifold 12 so as to help position the transducer 10 in spaced relation to the bottom of the intake manifold. The extent that the bottom portions of spring wires 50 extend from the bottom of the transducer 10 can be varied to adjust the positioning of the transducer 10. In some applications, the spring wire extension from the bottom of the transducer 10 can be eliminated. This is true where space is a factor or where the engagement of the upper ends of the spring wires 50 with the opening to the intake manifold is sufficient to hold transducer 10 in place. Also, it will be observed that the upper ends of the spring wires 50 can be cut off so as to position the transducer 10 in different sized intake manifolds. If desired, the ends of the spring wires 50 can be bent with a pliers or like tool to retain the ultrasonic transducer at a desired position.

The crystal 42 is designed to withstand at least 350° F. This is substantially higher than the normal manifold temperature of about 175° F. Under load, the manifold temperature is normally no more than 225°–250° F.

The engagement of the metal spring wires with the wall of the intake manifold functions to electrically ground the ultrasonic transducer 10.

It is important to observe that the transducer 10 can be installed by removing the carburetor 16 from the intake manifold 12. No modifications of the carburetor are necessary. The lead wire 20 can be positioned in a groove or recess in the gasket 21 between the carburetor 16 and the intake manifold 12. The lead wire 20 can be flat, as best shown in FIG. 3 or it could be round. The engine need not be altered or adjusted to accommodate the present invention. Installation of the transducer 10 will in no way degrade the performance or operation of the vehicle—it is a fail safe device that will allow the vehicle to operate as it did before the device was installed. Though no carburetor adjustment is necessary, further fuel economy can be effected by adjusting the choke to 80 percent open at start and by adjusting the carburetor by leaning out the fuel-air mixture.

Engine performance is improved by the transducer 10, because raw fuel from the carburetor impacting the active surface of the resonator is immediately changed to a fine vapor. Such vaporization occurs even though the engine is cold. Therefore, it is not necessary for the engine to reach normal operating temperatures before proper atomization of the fuel takes place. Through use of the present invention, the engine will easily start in cold weather, cold weather warm up of the engine is unnecessary, and engine stall when accelerating a cold engine under load is eliminated. The engine will run more quietly under load, whether the engine is hot or cold. Fuel savings are made by use of the present invention while boosting engine power.

Tests have been run by an independent laboratory utilizing the ultrasonic transducer of FIG. 4 and these have been tabulated below. The test vehicle was a 1980 Buick Skylark with a 2.8 liter V6 engine and automatic transmission. EPA cold start limits for this vehicles are HC—0.41 GPM; CO—7.0 GPM; and $NO^x$—2.0 GPM:

| | | Factory Baseline | Ultrasonic Transducer Test #1-% Change | | Ultrasonic Transducer Test #2-% Change | |
|---|---|---|---|---|---|---|
| Cold Start | HC | .26 GPM | .34 GPM | +31% | .21 GPM | −19% |
| | CO | 3.62 GPM | .85 GPM | −426% | 2.39 GPM | −34% |
| | $NO^x$ | 1.82 GPM | 1.97 GPM | +8% | 1.88 GPM | +3% |
| Carbon Balance MPG | | 18.01 MPG | 17.95 MPG | −.03% | 17.59 MPG | −2.3% |
| Hot Cycle | HC | 0.5 GPM | .03 GPM | −40% | .03 | −40% |
| | CO | .07 GPM | .01 GPM | −600% | .01 | −600% |
| | $NO^x$ | 3.12 GPM | 3.04 GPM | −3% | 2.64 | −15% |
| Carbon Balance MPG | | 24.26 MPG | 24.10 MPG | −.07% | 24.51 MPG | +1% |

It is to be observed that in Test No. 1, the idle screw was adjusted ¾ turn lean and the choke was set 90% lean. This incorrect carburetor setting resulted in a restart of the car, which adversely affected the results. For Test No. 2, the idle screw was set back to normal and the choke was set 60% lean.

A percent change of five percent (5%) is within the limits of repeatedly on test cycles. Fuel consumption figures did not change much because all tests were run at 70° F. to 75° F. and the choke is not influenced greatly at these temperatures.

The tests indicate that the ultrasonic transducer of this invention does have a positive influence on exhaust emissions by reducing unburned hydrocarbons and carbon monoxide.

In separate road tests, fuel savings on the order of five percent (5%) to fifteen percent (15%) have been effected utilizing the ultrasonic transducer of the present invention. These preliminary tests were performed on stock automobiles. Results were compared for each automobile without the ultrasonic transducer and then with the ultrasonic transducer.

Figure 4:
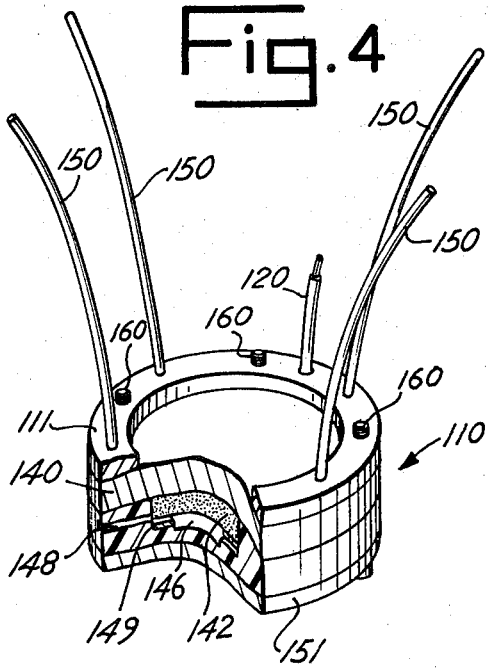
FIG. 4 is a perspective view of a modified ultrasonic transducer.

In FIG. 4, there is shown a modified transducer 110. The tranducer 110 comprises an annular retaining ring 111, a resonator 140, crystal 142, insulating body 144, preferably made from plastic, base plate 149, and spring wires or support legs 150. The resonator 140 is tuned to the frequency of the crystal 142. Lead wire 120, which is connected to the crystal and to the electric circuit for exciting the crystal to vibrate at a frequency of at least 1,000,000 Hz and preferably at least 1,300,000 Hz (cycles per second), is preferably a coated wire to protect it against the environment in which it functions. Teflon-coated wire has been found suitable for lead wire 120.

Figure 5:
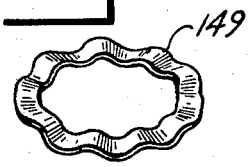
FIG. 5 is a perspective view of the wave washer used in the modification of FIG. 4.

An important feature of the embodiment of FIG. 4 is the resonator 140 and crystal 142 are not bonded to one another, but are urged into operative association by a wave washer or compensating spring 114, best shown in FIG. 5. The wave washer 149 is particularly useful with larger size transducers, wherein a more uniform pressure is applied to urge the crystal 142 against the resonator 140, regardless of temperature changes and attendant expansion and contraction of the components of transducer 110. Only the circumferential portion of the crystal 142 is engaged by the spring 114, and the central portion of the crystal is free to vibrate. The result is better vibration of the crystal, with attendant improved vibration of the resonator, and a greater output of vaporized liquid.

Vent means 148 are provided in transducer 110 to depressurize the bottom of the crystal 142 by avoiding gasoline buildup in chamber 146 and thereby permitting freer vibration of the crystal, in a simple, inexpensive fashion. The vent means 148 comprises openings or grooves in the body 144, which communicate the chamber 146 below the crystal 142 with the environment about transducer 110.

Figure 6:
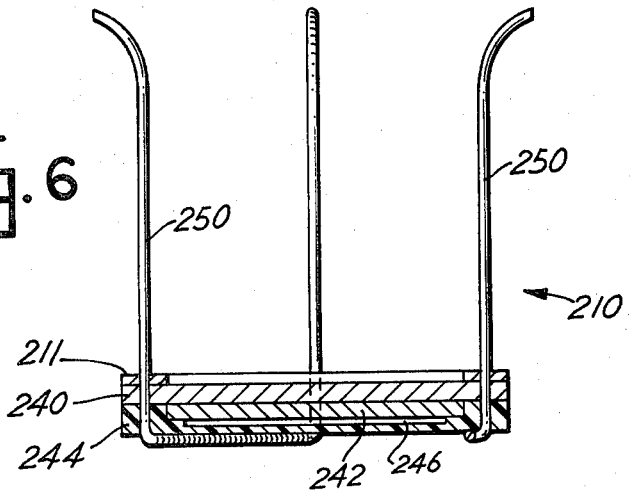
FIG. 6 is a cross-sectional view of another ultrasonic transducer taken generally along the line 6—6 of FIG. 7.
Figure 7:
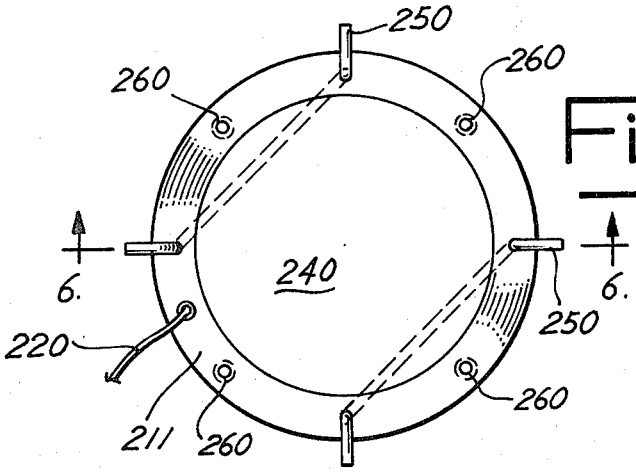
FIG. 7 is a plan view of the ultrasonic transducer of FIG. 6.

Another modification of the present invention is shown in FIGS. 6 and 7. The transducer 210 comprises a retaining ring 211, resonator 240, crystal 242, housing 244, lead wire 220, and wire support legs 250. The transducer 210 is held together by screws or rivets 260 (FIG. 7) which connect the retaining ring 211 to the housing 244 so as to sandwich the resonator and crystal therebetween. Resonator 240 is joined to the ring 211 and housing 244, whereas the crystal 242 is only retained at the edge, so that the central portion is free to vibrate when energy is applied thereto.

The support legs 250 as best shown in FIG. 6, comprises a U-shaped spring member inserted through holes in the transducer 210, as shown in FIG. 5. The ends of the legs can then be cut to the desired length for proper positioning of the transducer 210 in the intake manifold and the ends of the legs 250 can then be bent by a pliers or like tool to help retain the transducer in the desired position.

The transducer 210 functions in the same fashion as the embodiments previously described. Gas droplets from the carburetor will contact the upper active surface of the resonator 240. The droplets will be finely vaporized due to the vibration of the resonator 240 induced by the crystal 242, vibrated at an ultrasonic fequency at least 1,000,000 Hz, and preferably, 1,300,000 Hz.

Figure 8:
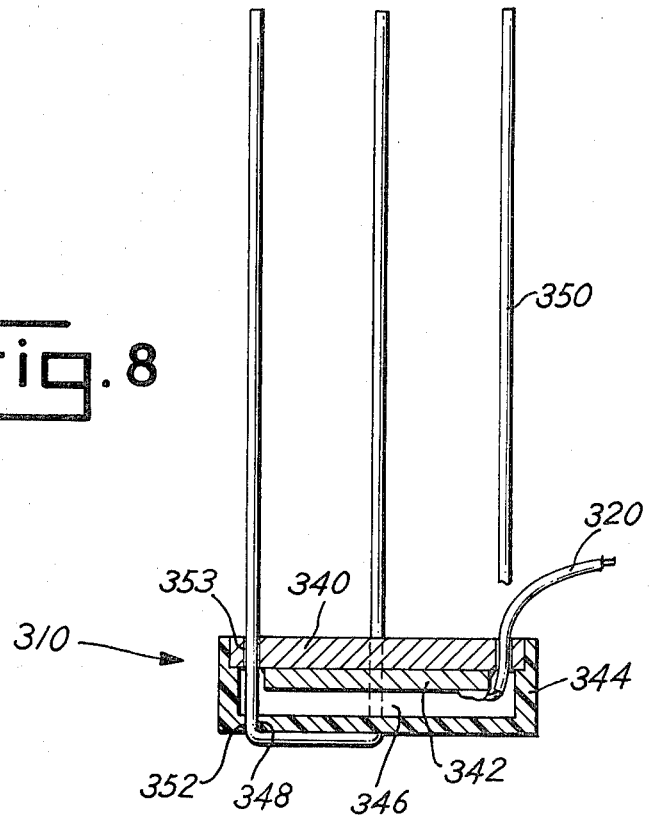
FIG. 8 is a cross-sectional view of a further embodiment of the ultrasonic transducer, taken generally along the line 8—8 of FIG. 9.
Figure 9:
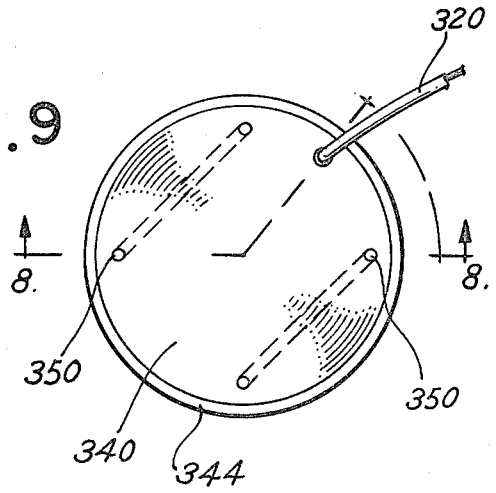
FIG. 9 is a plan view of the ultrasonic transducer of FIG. 8.

A more simplified and less costly embodiment of ultrasonic transducer is shown in FIGS. 8 and 9. The transducer 310 comprises resonator 340, crystal 342, insulted body 344, lead wire 320 and spring legs 350. The resonator 340 and crystal 342 are shown bonded to one another, for example by a high temperature epoxy cement.

The spring legs 350 are U-shaped members made, for example, from steel, as in the embodiment of FIGS. 6 and 7. The legs 350 extend through aligned holes 352 and 353 in the body 344 and resonator 340. The free ends of the support means or legs 350 can be cut to the desired lengths and bent to fix the transducer in place in the intake manifold, as described above.

Vent means 348 are provided to vent the chamber 346. Such vent means 348 are the space between the interior of holes 352 and the exterior of wires 350 extending through such holes.

As in the previous embodiments, the resonator 340 has a thickness of ¼ wavelength or another odd multiple of ¼ wavelength and is tuned to the resonant frequency of the crystal. The crystal 342 and resonator 340 are operatively engaged, e.g., by bonding using a high temperature epoxy. Such thickness for the crystal and resonator have been found to provide for best operating results for the novel transducer.

With the present invention, all fuel supplied to the cylinders of the engine will be finely vaporized and the cylinders will be applied with a uniform fuel-air mixture. In normal engine systems, the cylinders closer to the carburetor often receive more gas than cylinder more distant from the carburetor. There is better combustion of the fuel with each of the cylinders. The present invention provides a boost in engine power while saving gasoline. Carbon monoxide and hydrocarbon emissions are reduced.

The components of the electrical circuit consume minimal battery power while driving each transducer at a frequency of at least 1,000,000 Hz. The transducers each gasify or vaporize sufficient fuel to produce twenty (20) horsepower.

In summation, the present invention provides an ultrasonic transducer that assures fast cold weather starts, eliminates cold weather warm up, eliminates engine flooding, and operates the engine with leaner air-fuel mixtures. In addition to these fuel saving advantages, the present invention helps to eliminate engine knock, smooth out engine idle, saves the storage battery as a result of fast starts and reduces engine oil contamination. The engine will run smoother, even with water in the gas tank and fuel system. Should water get into the fuel system, it would be vaporized by the transducer together with the fuel.

While we have shown presently preferred embodiments of the present invention, it will be apparent that modifications may be made within the scope of the present invention as defined by the claims.

We claim:

1. For use in an internal combustion engine having a carburetion means connected to an engine intake manifold, the improvement comprising an ultrasonic transducer for vaporizing the fuel disposed substantially at the hot spot in the engine intake manifold, said transducer comprising a crystal adapted to be vibrated at a high frequency on the order of at least 1,000,000 Hz and a resonator tuned to the frequency of the crystal and operatively connected to the crystal, said resonator having an active surface adapted to be contacted by the fuel for finely vaporizing same for better mixture with the air from the carburetion means, whereby the internal combustion engine will deliver more power, while reducing carbon monoxide and hydrocarbon emissions, and saving fuel, and mounting means for supporting the ultrasonic transducer inside the engine intake manifold between an opening thereto through which the fuel/air mixture passes from the carburetion means and the hot spot of the engine intake manifold without any alteration of the engine intake manifold or engine specifications.

2. An ultrasonic transducer as in claim 1 wherein the thickness of the resonator is ¼ wavelength.

3. An ultrasonic transducer as in claim 2 wherein the thickness of the resonator is an odd multiple of ¼ wavelength.

4. An ultrasonic transducer as in claim 1 wherein the crystal is made from barium titanate and the resonator is made from metal.

5. An ultrasonic transducer as in claim 4 wherein the resonator is made from aluminum.

6. An ultrasonic transducer as in claim 1 wherein the transducer comprises said resonator, said crystal and an insulator body enclosing the crystal and forming a chamber between the crystal and the insulator body and means venting said chamber.

7. An ultrasonic transducer as in claim 1 wherein the crystal and the resonator are bonded to one another.

8. An ultrasonic transducer as in claim 6 wherein said venting means comprise passages in said insulator body.

9. An ultrasonic transducer as in claim 1 wherein said supporting means includes leg means extending from the transducer and adapted to engage a surface of the engine intake manifold.

10. An ultrasonic transducer as in claim 9 wherein the leg means engages the engine intake manifold to ground the ultrasonic transducer.

11. An ultrasonic transducer as in claim 9 wherein the leg means are comprised of U-shaped members, which extend through openings in the ultrasonic transducer.

12. Apparatus as in claim 1 including means for energizing the crystal to a high frequency of at least 1,000,000 Hz.

13. Apparatus as in claim 12 wherein said energizing means includes, an oscillator, a power amplifier for amplifying the signal from the oscillator and a modulator cooperating with the power amplifier to apply power to the ultrasonic transducer in a discontinuous manner.

14. Apparatus as in claim 13 wherein the modulator cooperates with the power amplifier to apply power to the crystal in bursts of approximately fifty percent (50%) duty cycle.

15. Apparatus as in claim 12 wherein said energizing means includes an oscillator and a power amplifier for amplifying the signal from the oscillator.

* * * * *